United States Patent [19]

Kreft

[11] 4,206,808

[45] Jun. 10, 1980

[54] SAFETY CENTERING BASKET

[76] Inventor: Günter Kreft, Hermann-Löns-Weg 5, D-4520 Melle 1, Fed. Rep. of Germany

[21] Appl. No.: 17,654

[22] Filed: Mar. 5, 1979

Related U.S. Application Data

[63] Continuation-in-part of Ser. No. 844,993, Oct. 25, 1977, Pat. No. 4,143,713.

[30] Foreign Application Priority Data

Mar. 3, 1978 [DE] Fed. Rep. of Germany ..... 2809181

[51] Int. Cl.[2] ..... E21B 17/10

[52] U.S. Cl. ..... 166/241; 267/164

[58] Field of Search ..... 166/241, 172, 173, 138, 166/166, 216; 175/325; 267/164, 158

[56] References Cited

U.S. PATENT DOCUMENTS

| | | | |
|---|---|---|---|
| 2,738,019 | 3/1956 | Atkinson | 166/241 |
| 2,898,136 | 8/1959 | Hall, Sr. et al. | 166/241 X |
| 3,000,444 | 9/1961 | Wright et al. | 166/241 |
| 4,042,022 | 8/1977 | Wills et al. | 166/241 |
| 4,077,470 | 3/1978 | Dane | 166/241 X |

*Primary Examiner*—Stephen J. Novosad

[57] ABSTRACT

A safety centering basket for the tubing of bores in mining, oilfield work and the like is of the kind having a number of resilient flat steel springs secured at their ends in respective end rings each having two half shells coupled by hinges, the improvement being that each flat steel spring is formed by a plurality of spring rods coupled together to form a unit, the pack of rods being clad in a layer of a heat stable protective material such as a plastics material.

9 Claims, 5 Drawing Figures

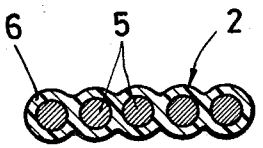
Fig. 3 (A-B)
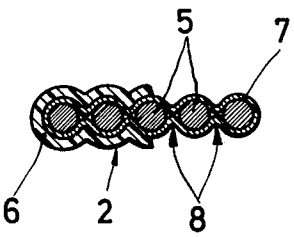
Fig.4 (C-D)
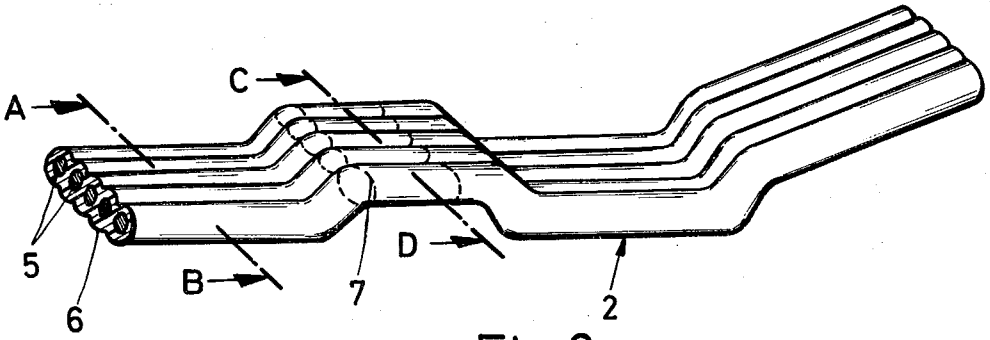
Fig.2
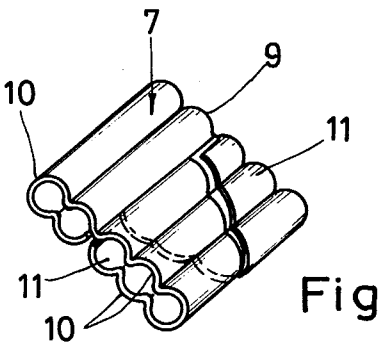
Fig.5

SAFETY CENTERING BASKET

This application is a continuation-in-part of my copending application Ser. No. 844,993 filed, Oct. 25th 1977, now U.S. Pat. No. 4,143,713.

The object of the invention relates to a safety centering basket for the tubing of bores in mining, in oil fields or the like, consisting of a number of a number of resilient flat steel springs which in each case are arranged endwise in openings of a steel ring formed of two half shells with hinges and are secured to this steel ring.

BACKGROUND OF THE INVENTION

By reason of the steel springs formed as blade springs the known centering baskets are only insertable for known depths, because the temperature rising with increasing depth has an influence on the elasticity of the steel springs and thus the faultless operation of the springs can be impaired.

OBJECT OF THE INVENTION

The object of the invention is to improve a safety centering basket according to the above mentioned art such that it is formed with flat springs which also during the insertion of the centering basket at great depths retain their full functioning capability and which are not impaired in their elasticity, springiness and shape by influence of temperature; accordingly the springs are simple to manufacture and economical to make as well as being constructed in a durable manner.

SUMMARY OF THE INVENTION

According to the invention the safety centering basket of the above-mentioned known kind is characterised in that each flat steel spring is formed of a plurality of spring rods arranged adjacent to each other and coupled together to form a unit and are clad in a heat stable protective layer, advantageously a layer of synthetic material.

In a preferred manner the individual spring rods of each flat spring are held together as a pack of springs by metallic clips and this pack is sprayed on all of its faces with a heat stable synthetic material.

Advantageous further features will be apparent from the other sub-claims. The object of the invention extends not only to the features of the individual claims but also to combinations thereof.

The safety centering basket according to the invention is provided with steel springs which in their essential external shape are flat and which are surrounded by a heat stable protective layer so that as a result the spring as a whole can be exposed to high temperatures without thereby losing its elasticity, strength and shape or having them impaired.

The springs formed of individual round spring rods and the cladding of synthetic material resemble in their shape and size the blade springs which were conventional hitherto. By reason of the heat stable layer of synthetic material the springs of the present invention can be exposed to a temperture up to 400° C. without thereby resulting in impairment of the security of operation of the springs.

With deep borings it is known that in deeper layers the temperature increases-there is applied a rule of thumb that there is an additional 30° C. of temperature per 1000 m. of bore depth. On the basis of the possibility to increase or decrease the number of the spring rods and also to alter their cross-section (diameter) there is created a broad basis which corresponds to the determined or required values. As a result it is also possible, when desired, for the oppositely acting forces of the so-called Restoring force and the Starting force to be advantageously made equal to each other, which is not possible with the conventional blade springs.

The springs are simple to make, economical to manufacture, and have a long useful life as well as secure operation.

With reference to the drawings an example of embodiment of the invention will now be described in more detail.

BRIEF DESCRIPTION OF THE DRAWINGS

In the drawings:

FIG. 2 is a partial perspective view of a flat spring;

FIG. 3 is a cross-section through the flat spring taken on the section line A-B in FIG. 2;

FIG. 4 is a cross-section through the flat spring according to the section line C-D in FIG. 2; FIG. 5 is a perspective view of a clip.

DESCRIPTION OF THE PREFERRED EMBODIMENTS

Figure 1:
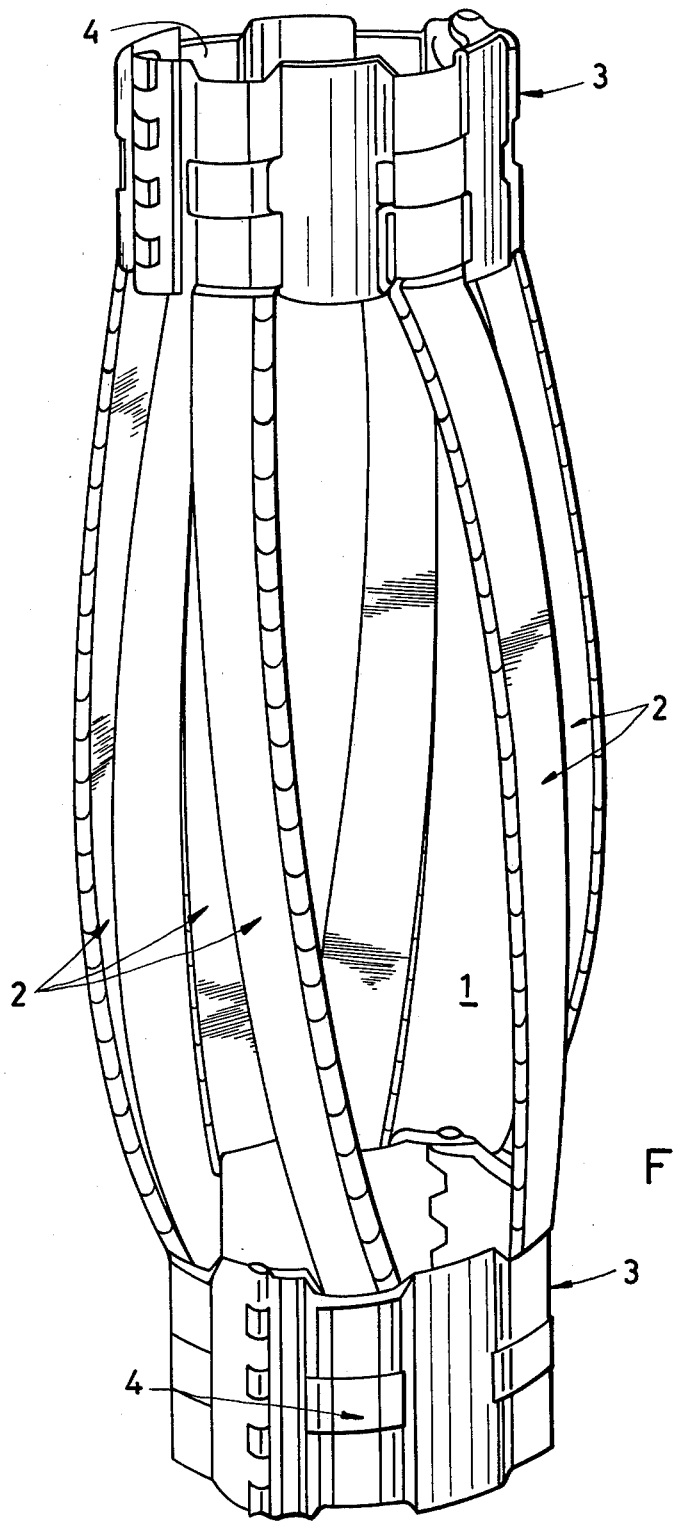
FIG. 1 is a perspective view of a safety centering basket with a plurality of resilient flat springs and steel rings at the end.

The safety centering basket illustrated in FIG. 1 is denoted in its entirety by 1 and is composed of a number of resilient flat steel springs 2 and steel rings 3 at both longitudinal ends of the steel springs 2.

The steel rings 3 are formed of two half shells secured together by hinges, and have openings 4 as well as bridge portions disposed in the region of the openings 4 and engaging behind the longitudinal ends of the flat springs inserted in the openings 4 and which are not visible in FIG. 1, so that the flat springs 2 are removably retained in the openings 4 by the bridge portions.

Each flat steel spring 2 is formed from a number of spring rods which are adjacently arranged and secured together to form a unit, said rods being advantageously round spring rods 5, and is clad in a heat stable protective layer 6.

The protective layer 6 is advantageously formed of a highly heat stable synthetic plastics material.

On the entire length of the flat springs 2 there are arranged at least one, preferably at two or more spaced positions, metallic clips 7 which secure together the adjacently lying round spring rods 5 in a pack.

These metallic clips 7 can be formed in various ways, for example as doubled half shells with flanges or as one-piece ring clips with clip bends corresponding to the number of ring spring rods 5, and in that way the individual clips respectively held together between neighbouring round spring rods 5 by spot weldings 8, so that the individual clips or the one-piece clips form a clamping member which holds together the individual round spring rods 5 in an adjacently running bar profile formed of a plurality of individual rods and with a flat (rectangular) basic cross-section.

The spring rods 5 will be cut off according to the hitherto usual and well known shape of the steel flat springs, namely with multiple-bend end portions at each end for securing in the steel ring 3 and the possibly pre-formed central arched portion; the spring rods 5 cut off in this manner or bent according to requirements will then be secured together in the pack by the clips 7 and finally bound together by spraying with the heat stable synthetic material 6 on all faces to form the flat spring 2, so that this flat spring 2 formed from the spring rods 5 and the clips 7 as well as the cladding 6 of synthetic material corresponds in cross-sectional shape and in cross-sectional dimensions to the conventional flat steel spring.

In preferred manner the spring steel rods 5 are enclosed over their entire length and the entire periphery of the flat spring 2 by the layer of synthetic material; there is nevertheless the possibility according to requirements or circumstances to provide the cladding of synthetic material only on part of the flat spring 2, for example to omit it in the region of the clips 7.

In preferred manner the spring rods 5 are formed of round rods (rods with circular cross-section). In a further preferred embodiment the individual spring rods 5 have an angular; such as rectangular, quadratic, six-sided or polygonal cross-section, and they could also have an oval cross-section.

The number, cross-sectional shape and cross-sectional dimensions of the individual rods 5 of each spring 2 can be selected according to desire and requirements.

In FIG. 5 of the drawing there is shown a clip, 7 especially developed for the round spring rods 5, which is formed of a strip 9 of flat material, and with which a greater number of part-circular of encircling or over-engaging bends 10 are provided and which lies with its strip ends 11 on opposite sides for the closing of the single-piece multiple-tube type clip 7 inside the clip housing.

The spring rods 5, as shown in the drawing, are arranged in one plane and spaced from each other. In another embodiment, not shown, the spring rods 5 are provided in two or more planes, and for example three spring rods 5 could be positioned in a lower plane and three spring rods in an upper plane, so that the spring rods 5 are placed together. The spring rods 5 arranged in multiple planes are also clad with the protective layer 6.

By the arrangement of the spring rods 5 in various planes there is an improved moment of resistance.

I claim:

1. In a safety centering basket for use with the tubing of mining bores, oilfield bores and the like, of the kind having a number of resilient flat steel springs each engaged endwise in openings of respective end steel rings each formed of two half shells with hinges, the springs being secured to the end rings, the improvement that each flat steel spring is formed of a plurality of spring rods arranged in adjacent positions and coupled together to form a unit, the unit being clad in a layer of heat stable protective material.

2. A safety centering basket, as claimed in claim 1, wherein the spring rods of each steel spring unit have a circular or multiple-angled cross-section.

3. A safety centering basket, as claimed in claim 1, wherein the spring rods of the unit are secured together as a pack by metallic clip means.

4. A safety centering basket, as claimed in claim 3, wherein metallic clips are disposed in at least one position along the length of the unit, said clips being engaged about the spring rods of the unit and being secured between adjacent spring rods by welding.

5. A safety centering basket, as claimed in claim 4, wherein each clip is made from a strip of flat material with a multiple-tube formation with adjacently positioned part-circular enclosing bends, the ends of the flat strips being positioned at opposite sides of a onepiece peripherally closed clip.

6. A safety centering basket, as claimed in claim 1, wherein the spring rods are bent along their length corresponding to the shape of a flat spring.

7. A safety centering basket, as claimed in claim 1, wherein the pack of spring rods of the unit has a cladding of a highly heat stable plastics material surrounding the pack on all of its surfaces.

8. A safety centering basket, as claimed in claim 1, wherein the spring rods are arranged adjacent to each other and spaced in one plane.

9. A safety centering basket, as claimed in claim 1, wherein the spring rods are arranged in at least two planes.

* * * * *